US010118810B2

(12) United States Patent
Ahern et al.

(10) Patent No.: US 10,118,810 B2
(45) Date of Patent: Nov. 6, 2018

(54) METHOD AND SYSTEM FOR A LOW HEIGHT LIFT DEVICE

(71) Applicant: Xtreme Manufacturing, LLC, Las Vegas, NV (US)

(72) Inventors: Don Francis Ahern, Las Vegas, NV (US); Ronald Lee Fifield, Las Vegas, NV (US)

(73) Assignee: Xtreme Manufacturing, LLC, Las Vegas, NV (US)

( * ) Notice: Subject to any disclaimer, the term of this patent is extended or adjusted under 35 U.S.C. 154(b) by 56 days.

(21) Appl. No.: 14/164,570

(22) Filed: Jan. 27, 2014

(65) Prior Publication Data

US 2015/0210520 A1 Jul. 30, 2015

(51) Int. Cl.
*B66F 11/04* (2006.01)

(52) U.S. Cl.
CPC ..... *B66F 11/042* (2013.01); *Y10T 29/49826* (2015.01)

(58) Field of Classification Search
CPC ..... B66F 11/00; B66F 11/04; B66F 11/042; E04G 1/22; E04G 1/24; E04G 2001/242; Y10T 29/49826
USPC ..... 248/277.1
See application file for complete search history.

(56) References Cited

U.S. PATENT DOCUMENTS 2,625,443 A 1/1953 Sensenbaugh
3,796,282 A * 3/1974 Denier et al. ..... 182/141
4,088,203 A * 5/1978 Smith, Jr. ..... 182/141
4,113,065 A * 9/1978 Sikli ..... 187/243
4,175,644 A * 11/1979 Sikli ..... 187/269
4,375,248 A * 3/1983 Kishi ..... 187/269
4,457,403 A 7/1984 Ream
4,599,030 A 7/1986 Skaalen et al.
4,867,277 A 9/1989 Sloan
(Continued)

OTHER PUBLICATIONS

International Search Report and Written Opinion, dated May 7, 2015, for co-pending International patent applicatio No. PCT/US2015/013063, from the International Searching Authority (18 pgs.).

(Continued)

*Primary Examiner* — Katherine W Mitchell
*Assistant Examiner* — Shiref M Mekhaeil
(74) *Attorney, Agent, or Firm* — Armstrong Teasdale LLP

(57) ABSTRACT

A method and system for a scissors lift vehicle are provided. The scissors lift vehicle includes a carriage including a plurality of independently steerable wheels configured to engage a travel surface, the wheels including an axis of rotation and a circular profile having a radius R, the wheels spaced apart in a fore/aft direction and in a right/left direction. The scissors lift vehicle also includes a base coupled to the carriage between the wheels spaced apart in the right/left direction within a profile of the wheels and a scissors stack assembly including a plurality of scissors linkages extendable from a retracted position, where the scissors linkages are approximately horizontally configured to an extended position, where the scissors linkages are approximately orthogonally configured with respect to each other, the scissors stack assembly pivotally coupled to the base through a first pair of scissors linkages, the scissors stack assembly slidably coupled to the base through a second pair of scissors linkages.

15 Claims, 2 Drawing Sheets

(56) References Cited

U.S. PATENT DOCUMENTS

| | | | | |
|---|---|---|---|---|
| 5,148,885 | A | 9/1992 | Weyer | |
| 5,547,038 | A | 8/1996 | Madwed | |
| 5,570,754 | A | 11/1996 | Stimson | |
| 5,890,737 | A * | 4/1999 | Hutka | 280/755 |
| 6,044,927 | A * | 4/2000 | Newlin | 182/69.5 |
| 6,050,365 | A * | 4/2000 | Newlin | 182/69.5 |
| 6,540,039 | B1 | 4/2003 | Yu et al. | |
| 6,883,641 | B2 * | 4/2005 | Julien | 182/69.1 |
| 7,493,987 | B2 | 2/2009 | Puszkiewicz et al. | |
| 7,717,210 | B2 * | 5/2010 | Mahy et al. | 180/209 |
| 8,215,441 | B2 | 7/2012 | Wierzba et al. | |
| 8,262,109 | B1 | 9/2012 | Bell et al. | |
| 8,306,699 | B2 * | 11/2012 | Scheer | 701/41 |
| 8,332,089 | B2 * | 12/2012 | Nakazawa | 701/22 |
| 8,602,713 | B1 * | 12/2013 | Davis | B60P 1/025 254/10 C |
| 2002/0088665 | A1 * | 7/2002 | Brown | 180/418 |
| 2003/0029673 | A1 * | 2/2003 | Puszkiewicz et al. | 182/69.1 |
| 2003/0173130 | A1 * | 9/2003 | Johns | B25J 5/007 180/234 |
| 2004/0062630 | A1 * | 4/2004 | Marrero | 414/589 |
| 2005/0183896 | A1 | 8/2005 | Fenelli et al. | |
| 2006/0151252 | A1 * | 7/2006 | Joos | 187/269 |
| 2006/0225955 | A1 * | 10/2006 | Murphy | 182/69.5 |
| 2008/0087484 | A1 | 4/2008 | Fenelli et al. | |
| 2009/0200117 | A1 * | 8/2009 | Farber et al. | 187/269 |
| 2010/0193290 | A1 | 8/2010 | Cui | |
| 2011/0224872 | A1 * | 9/2011 | Reed | 701/41 |
| 2012/0186908 | A1 * | 7/2012 | Crook et al. | 182/69.5 |

OTHER PUBLICATIONS

Extended EP Search Report, dated Aug. 7, 2017, for co-pending EP patent application No. EP 15740324.7 (8 pgs.).

* cited by examiner

METHOD AND SYSTEM FOR A LOW HEIGHT LIFT DEVICE

BACKGROUND

This description relates to lift devices, and, more particularly, to an adjustable height man lift and methods of assembling adjustable height man lifts.

Scissors lifts are a type of platform that can usually only be moved in a vertical direction. The lift mechanism is often mounted to a self propelled carriage or chassis having wheels for moving the platform between work areas. The mechanism to achieve the vertical lift is a plurality of linked, folding supports oriented in a crisscross or "X" pattern. The pattern is also known as a pantograph. The upward motion is achieved by the application of a force to a set of parallel linkages, elongating the crossing pattern, and propelling the work platform vertically. Because scissors lift devices evolved from a device that included a scissors lift assembly mounted on a pulled carriage that was not self-propelled, current scissor lift designs still have the scissors lift assembly mounted on top of a carriage. In self-propelled models, many of the propelling features are mounted under the scissors lift assembly. A hydraulic system, electrical system including batteries, and a control system are also typically mounted on the carriage below the scissors lift assembly. Additionally, axles, steering and transmission components are also mounted on the carriage under the scissors lift assembly. Accordingly, because of the equipment located under the scissors lift assembly on the carriage, the height of the work platform that carries a user to the work area is greatly elevated above the floor surface. To gain access to the work platform of known scissors lift assemblies, the user must climb onto the platform, usually using several ladder steps attached to the carriage and/or platform, and usually carrying tools, equipment, and/or repair parts. Such access is dangerous and laborious for the user. Moreover, mounting the scissors lift assembly on top of the carriage increases the height of the scissors lift vehicle when the scissors lift assembly is fully retracted. The increased height limits areas that the scissors lift vehicle can access.

BRIEF DESCRIPTION OF THE DISCLOSURE

In one aspect, a scissors lift vehicle includes a carriage including a plurality of independently steerable wheels configured to engage a travel surface, the wheels including an axis of rotation and a circular profile having a radius R, the wheels spaced apart in a fore/aft direction and in a right/left direction. The scissors lift vehicle also includes a base coupled to the carriage between the wheels spaced apart in the right/left direction within a profile of the wheels and a scissors stack assembly including a plurality of scissors linkages extendable from a retracted position, where the scissors linkages are approximately horizontally configured to an extended position, where the scissors linkages are approximately orthogonally configured with respect to each other, the scissors stack assembly pivotally coupled to the base through a first pair of scissors linkages, the scissors stack assembly slidably coupled to the base through a second pair of scissors linkages.

In another aspect, a method of assembling a scissors lift vehicle includes providing a substantially rectangular carriage, the substantially rectangular carriage including a base having a receptacle for a pivot joint and a slot for a slidable joint and coupling a plurality of independently steerable wheels to the carriage, the wheels each including an axis of rotation and a radius R, at least one wheel positioned proximate each corner of the rectangular carriage. The method also includes coupling a scissors stack assembly to the base, the scissors stack assembly pivotally coupled to the base through a first pair of scissors linkages, the scissors stack assembly slidably coupled to the base through a second pair of scissors linkages, where the base is positioned in a base plane vertically displaced from an axes plane including the axes of rotation a distance less than or equal to R.

In yet another aspect, a scissors lift vehicle includes a carriage including a plurality of independently steerable wheels configured to engage a travel surface, the wheels including an axis of rotation and a circular profile having a radius R, one of the plurality of wheels positioned proximate each corner of the rectangular carriage, a base coupled to the carriage between the plurality of wheels within a profile of the wheels, and a scissors stack assembly including a plurality of scissors linkages extendable from a retracted position, where the scissors linkages are approximately horizontally configured to an extended position, where the scissors linkages are approximately orthogonally configured with respect to each other, the scissors stack assembly pivotally coupled to the base through a first pair of scissors linkages, the scissors stack assembly slidably coupled to the base through a second pair of scissors linkages.

BRIEF DESCRIPTION OF THE DRAWINGS

FIG. 1 is a side elevation view of a scissors lift vehicle in accordance with an example embodiment of the present disclosure.

FIG. 2 is a flow diagram of a method of assembling a scissors lift vehicle in accordance with an example embodiment of the present disclosure.

Figure 1:
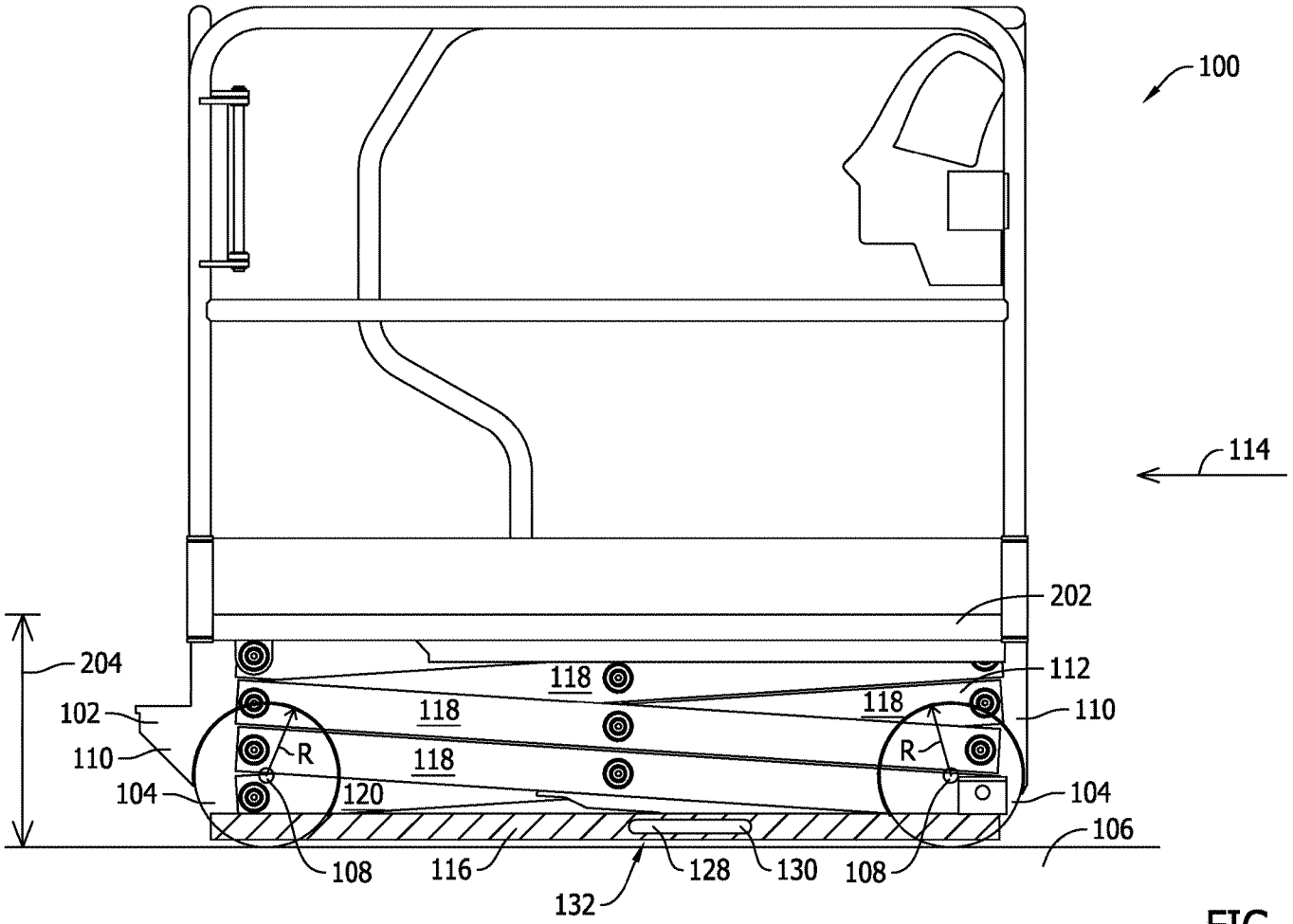
FIGS. 1 and 2 show example embodiments of the method and apparatus described herein.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION OF THE DISCLOSURE

The following detailed description illustrates embodiments of the disclosure by way of example and not by way of limitation. It is contemplated that the disclosure has general application to embodiments of a scissors lift vehicle and a method of assembling a scissors lift vehicle.

In the example embodiment, the scissors lift vehicle includes a carriage comprising a plurality of independently steerable wheels configured to engage a travel surface. The travel surface could be any sufficiently smooth surface, which permits the scissors lift vehicle to operate thereon, for example, but not limited to an asphalt surface. Travel surface may be, for example, concrete, wood, carpet, tile, or other surface in an indoor application of the scissors lift vehicle.

The wheels are configured to rotate about an axis of rotation powered by a respective drive unit, such as, but not limited to an electric motor coupled directly to the wheel or to the wheel through a gear or transmission assembly. The wheels include a circular profile having a radius R and are spaced apart from each other along the underside of the carriage. Typically, one wheel is positioned at or near each corner of the rectangularly-shaped carriage. The wheels are spaced as far as possible to improve the stability of the scissors lift vehicle, especially when the scissors stack assembly is extended. In various embodiments, more than four wheels, one at each corner may be used. Additionally, carriage may not be regularly-shaped, but may have other shapes, where additional wheels could be used. The wheels may be spaced apart in a fore/aft direction and in a right/left or athwartship direction.

A base is coupled to or formed with the carriage between the wheels spaced apart in the right/left direction and is positioned vertically such that the base lies within a profile of the wheels. For example, if the wheels are twelve inches in diameter, the base is positioned vertically less than twelve inches above the lowest extent of the wheels, which, in most cases, would be the equivalent of being less than twelve inches above the travel surface. Accordingly, in some embodiments, the base may be located less than 2R above the travel surface during operation of the scissors lift vehicle and in other embodiments the base may be located less than R above the travel surface during operation of the scissors lift vehicle.

In the example embodiment, the scissors stack assembly includes a plurality of scissors linkages extendable from a retracted position, where the scissors linkages are approximately horizontally configured to an extended position, where the scissors linkages are approximately orthogonally configured with respect to each other. The scissors stack assembly is pivotally coupled to the base through a first pair of scissors linkages and is slidably coupled to the base through a second pair of scissors linkages. The base includes a slot configured to receive a pin. The base and the first pair of scissors linkages are coupled in a pivotal joint. The base and the second pair of scissors linkages are coupled in a slidable joint using the slot and pin. The pivotal joint and the slidable joint are located between the wheels spaced apart in the right/left direction and within a profile of the wheels.

The scissors lift vehicle may also include a battery compartment coupled to or formed in the carriage and that extends between the fore and aft spaced wheels and is positioned outboard of the scissors stack assembly. The battery compartment includes a power source configured to supply a total electrical requirement of the scissors lift vehicle. The scissors lift vehicle may include a plurality of battery compartments. Each battery compartment is located between the fore and aft wheels on each side of the scissors lift vehicle. Typically, the power source is a battery. In some embodiments, the power source may be embodied in an engine.

Because some of the applications for the scissors lift vehicle include lifting workers and their equipment in the interior of buildings, the scissors lift vehicle size is limited to in an athwartships direction to a distance that is less than typical door openings. The width of typical door openings may vary by geographic location, which would tend to dictate the desirable width of the scissors lift vehicle. For example, a rough opening of a typical interior doorway in the United States may be approximately 36.0 inches (91.44 centimeters). Consequently a scissors lift vehicle that will be used during early construction phases of a building would have a width limitation of less than 91 centimeters (cm) to ensure it could fit through a rough opening of a doorway. A scissors lift vehicle that will be used in a finished building where the door jambs have been installed may be limited in width to less than about 35.0 inches (88.9 cm). Similarly, a scissors lift vehicle that will be used in a finished building with interior doors hung would be limited in width to about 33.0 inches (83.82 cm). Similarly, for example, a typical door size in Australia may be about 30.0 inches (76.2 cm). The scissors lift vehicle could be sized for use in Australia or other geographic areas having different size doorways.

The following description refers to the accompanying drawings, in which, in the absence of a contrary representation, the same numbers in different drawings represent similar elements.

FIG. 1 is a side elevation view of a scissors lift vehicle 100 in accordance with an example embodiment of the present disclosure. In the example embodiment, scissors lift vehicle 100 includes a carriage 102 that includes a plurality of independently steerable wheels 104, each configured to engage a travel surface 106 during operation of scissors lift vehicle 100. Travel surface 106 could be an asphalt surface in an outdoor application of scissors lift vehicle 100 or may be concrete, wood, carpet, tile, or other surface in an indoor application of scissors lift vehicle 100. Wheels 104 are configured to rotate about an axis of rotation 108 and may be powered by a dedicated motor (not shown) coupled directly to each wheel 104. Wheels include a circular profile having a radius R and are spaced apart from each other along an underside of carriage 102. Typically, one wheel 104 is positioned at or near each corner 110 of rectangularly-shaped carriage 102. In various embodiments, wheels 104 are spaced as far as possible to improve the stability of scissors lift vehicle 100, especially when a scissors stack assembly 112 is extended. In various embodiments, more than four wheels 104, one at each corner 110 may be used. Additionally, carriage 102 may not be rectangularly-shaped, but may have other shapes, where additional wheels 104 could be used. Wheels 104 may be spaced apart in a fore/aft direction 114 and in a right/left or athwartship direction (i.e., into or out of the page). Wheels 104 may be spaced from each other unequal distances apart, for example, a track of the fore wheels may be wider or narrower than the track of the aft wheels.

A base 116 is coupled to or formed with carriage 102 between wheels 104 and is positioned vertically such that base 116 lies within a profile of wheels 104. For example, if wheels 104 are twelve inches in diameter, base 116 is positioned vertically less than twelve inches above the lowest extent of wheels 104, which, in most cases, would be the equivalent of being less than twelve inches above travel surface 106. Accordingly, in some embodiments, base 116 may be located less than 2R above travel surface 106 during operation of scissors lift vehicle 100 and in other embodiments base 116 may be located less than R above travel surface 106 during operation of scissors lift vehicle 100.

In the example embodiment, scissors stack assembly 112 includes a plurality of scissors linkages 118 pivotally coupled together and extendable from a retracted position (shown in FIG. 1), where the scissors linkages are approximately horizontally configured to an extended position (not shown in FIG. 1), where the scissors linkages are approximately orthogonally configured with respect to each other. Scissors stack assembly 112 is pivotally coupled to base 116 through a first pair of scissors linkages 120 and 122 (122 is hidden behind 120 in FIG. 1) and is slidably coupled to base 116 through a second pair of scissors linkages, 124 and 126

(126 is hidden behind 124 in FIG. 1). Base 116 includes a slot 128 configured to receive a pin 130. Base 116 and first pair of scissors linkages 120 and 122 are coupled in a pivotal joint (not shown in FIG. 1). Base 116 and second pair of scissors linkages 124 and 126 are coupled in a slidable joint 132 using slot 128 and pin 130. Pivotal joint 132 and the slidable joint are located between wheels 104 spaced apart in the right/left direction and within a profile of wheels 104.

In the example embodiment, scissors lift vehicle 100 includes base 116 positioned below axis 108 such that base is less than R distance above travel surface 106. Such a position permits scissors stack assembly 112 to be positioned lower in relation to travel surface than other known scissors lift vehicles. Accordingly, a deck 202 is mounted to scissors stack assembly 112 at a relatively lower height 204 above travel surface 106 than other known scissors lift vehicles. Height 204 is configured to conform to a standard step height of a user for entry onto deck 202 directly from travel surface 106 without intermediate stepping surfaces, such as, steps, stairs, or pegs. In the example embodiment, a standard step height of about 20.0 inches is contemplated based on ANSI/SIA A92.6-2006. Other step heights may be selected based on local custom or other regulations.

Figure 2:
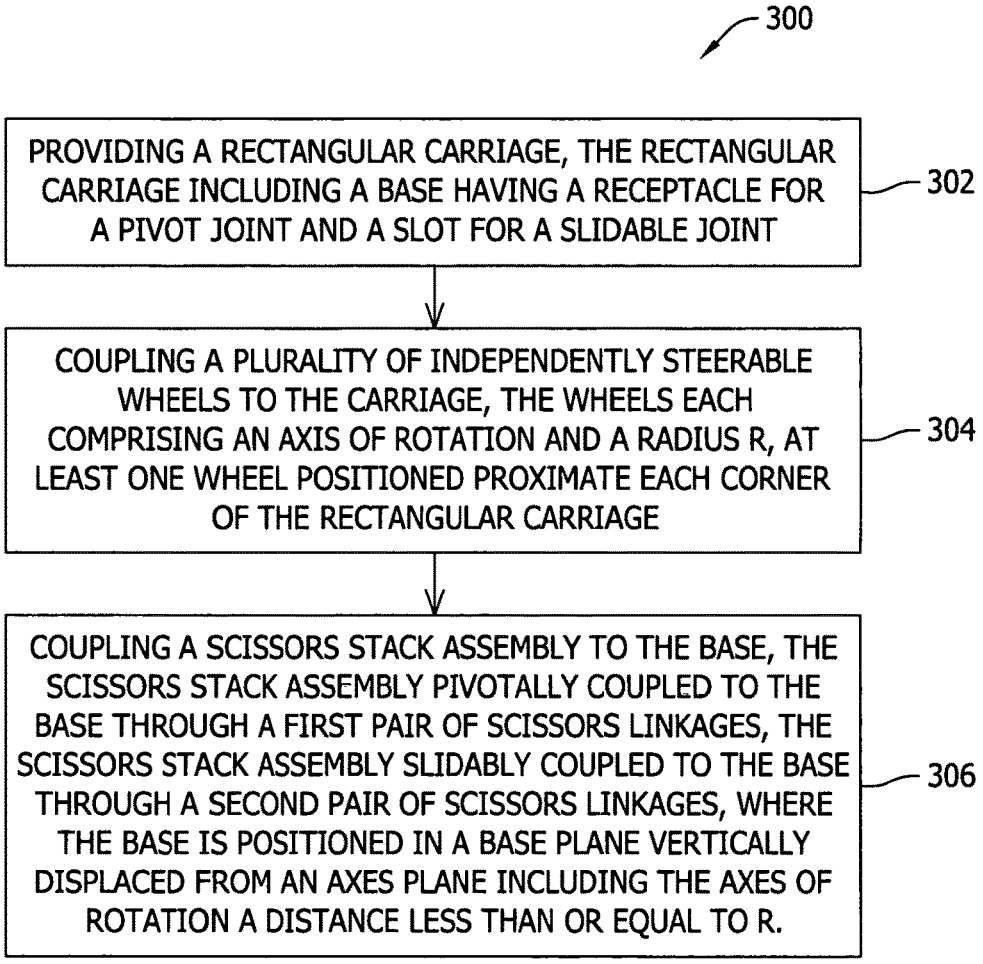

FIG. 2 is a flow diagram of a method 300 of assembling a scissors lift vehicle 100 in accordance with an example embodiment of the present disclosure. In the example embodiment, method 300 includes providing 302 a rectangularly-shaped carriage that includes four sides approximately 90 degrees apart. The rectangularly-shaped carriage includes a base Method 300 also includes coupling 304 a plurality of independently steerable wheels to the carriage. The wheels each include an axis of rotation and a radius R. Method 300 further includes coupling 306 a scissors stack assembly to the base. The scissors stack assembly may be pivotally coupled to the base through a first pair of scissors linkages and slidably coupled to the base through a second pair of scissors linkages. The base is positioned in a base plane vertically displaced from an axes plane including the axes of rotation a distance less than or equal to R.

Method 300 optionally includes coupling a scissors stack assembly that includes a plurality of scissors linkages to the base, the plurality of scissors linkages extendable from a retracted position. Method 300 may also include coupling a plurality of independently steerable wheels to the carriage such that the axes plane is parallel to a travel surface on which the scissors lift vehicle is configured to operate. Additionally, method 300 may also include coupling a deck to the scissors stack assembly at an end opposite the base, the deck being less than 2R above the travel surface when the plurality of scissors linkages are in the retracted position. Method 300 optionally includes coupling a deck to the scissors stack assembly at an end opposite the base, the deck being less than 3R above the travel surface when the plurality of scissors linkages are in the retracted position. Moreover, method 300 may include providing a rectangular carriage having an overall length and an overall width, the overall length being greater than the overall width, the overall width being less than approximately 78 centimeters or less than approximately 69 centimeters.

The process flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The above-described embodiments of a method and system of a scissors lift vehicle provide a cost-effective and reliable means of lifting workers to an elevated work site. More specifically, the methods and systems described herein facilitate a worker's ingress and egress to a work platform coupled to a scissors lift assembly portion of the scissors lift vehicle. In addition, the above-described methods and systems facilitate accessing narrow portals to work areas. As a result, the methods and systems described herein facilitate worker safety and work site access in a cost-effective and reliable manner.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A scissors lift vehicle comprising:

a plurality of wheels configured to engage a travel surface and comprising a circular profile having a radius R, each wheel of the plurality of wheels powered by a respective drive unit, each wheel of the plurality of wheels steerable independently of each of the other of the plurality of wheels; and a scissors stack assembly comprising a plurality of scissors linkages oriented in a crisscross pattern wherein a bottom pair of scissors linkages of the plurality of scissors linkages is slidably coupled to a base of the scissors lift vehicle through a slot and a pin arrangement, said scissors stack assembly positioned with a portion of the plurality of scissors linkages positioned less than R above a surface of the plurality of wheels at a point along the surface where the surface contacts the travel surface during operation of the scissors lift vehicle.

2. The scissors lift vehicle of claim 1, further comprising a battery compartment formed in a carriage of the scissor lift vehicle and extending between the wheels and outboard of the scissors stack assembly.

3. The scissors lift vehicle of claim 2, wherein the battery compartment includes a power source configured to supply a total electrical requirement of the vehicle.

4. The scissors lift vehicle of claim 2, further comprising a first battery compartment formed in the carriage and extending between the wheels on a first side of the carriage and outboard of the scissors stack assembly, and further comprising a second battery compartment formed in the carriage and extending between the wheels on a second side of the carriage and outboard of the scissors stack assembly.

5. The scissors lift vehicle of claim 1, wherein a width of the scissors lift vehicle is less than about 78 centimeters.

6. The scissors lift vehicle of claim 1, wherein a width of the scissors lift vehicle is less than about 69 centimeters.

7. A method of assembling the scissors lift vehicle of claim 1, the method comprising:

providing a substantially rectangular carriage, the substantially rectangular carriage including the base having a receptacle for a pivot joint and the slot for a slidable joint;

coupling the plurality of independently steerable wheels to the carriage, the wheels each comprising an axis of rotation and the radius R, at least one wheel positioned proximate each corner of the rectangular carriage; and coupling the scissors stack assembly to the base, the scissors stack assembly pivotally coupled to the base through a first pair of scissors linkages of the plurality of scissors linkages, the scissors stack assembly slidably coupled to the base through said bottom pair of scissors linkages of the plurality of scissors linkages, where the base is positioned in a base plane vertically displaced from an axes plane including the axes of rotation a distance less than or equal to R.

8. The method of claim 7, wherein coupling the scissors stack assembly to the base comprises coupling the scissors stack assembly that includes the plurality of scissors linkages to the base, the plurality of scissors linkages extendable from a retracted position, where the scissors linkages are approximately horizontally configured to an extended position, where the scissors linkages are approximately orthogonally configured with respect to each other.

9. The method of claim 7, wherein coupling a plurality of independently steerable wheels to the carriage comprises coupling a plurality of independently steerable wheels to the carriage such that the axes plane is parallel to the travel surface on which the scissors lift vehicle is configured to operate.

10. The method of claim 7, further comprising coupling a deck to the scissors stack assembly at an end opposite the base, the deck being less than 3R above the travel surface when the plurality of scissors linkages are in the retracted position.

11. The method of claim 7, further comprising coupling a deck to the scissors stack assembly at an end opposite the base, the deck being less than 4R above the travel surface when the plurality of scissors linkages are in the retracted position.

12. The method of claim 7, wherein providing a rectangular carriage comprises providing a rectangular carriage having an overall length and an overall width, the overall length being greater than the overall width, the overall width being less than approximately 91 centimeters.

13. The method of claim 7, wherein providing a rectangular carriage comprises providing a rectangular carriage having an overall length and an overall width, the overall length being greater than the overall width, the overall width being less than approximately 83 centimeters.

14. A scissors lift vehicle comprising:

a plurality of wheels, each wheel comprising an axis of rotation independent of an axis of rotation of others of the plurality of wheels and a circular profile having a respective radius R, each wheel of the plurality of wheels powered by a respective drive unit; and a scissors stack assembly comprising a plurality of scissors linkages oriented in a crisscross pattern wherein a bottom pair of scissors linkages of the plurality of scissors linkages is slidably coupled to a base of the scissors lift vehicle through a slot and a pin arrangement, the scissors stack assembly is extendable from a retracted position, a portion of the plurality of scissors linkages positioned less than R above the lowest extent of the wheels during operation of the scissors lift vehicle.

15. The scissors lift vehicle of claim 14, wherein a width of the scissors lift vehicle is less than about 91 centimeters.

* * * * *